US010462546B2

(12) United States Patent
Proni et al.

(10) Patent No.: US 10,462,546 B2
(45) Date of Patent: Oct. 29, 2019

(54) ILLUMINATED SPEAKER

(71) Applicants: Lucio Proni, Weston, FL (US); Dwayne H Spanbroek, Boca Raton, FL (US); Carlos A Gomez, Pembroke Pines, FL (US)

(72) Inventors: Lucio Proni, Weston, FL (US); Dwayne H Spanbroek, Boca Raton, FL (US); Carlos A Gomez, Pembroke Pines, FL (US)

(73) Assignee: JL Audio, Inc., Miramar, FL (US)

( * ) Notice: Subject to any disclaimer, the term of this patent is extended or adjusted under 35 U.S.C. 154(b) by 12 days.

(21) Appl. No.: 15/917,923

(22) Filed: Mar. 12, 2018

(65) Prior Publication Data

US 2019/0281374 A1 Sep. 12, 2019

(51) Int. Cl.

| | |
|---|---|
| ***H04R 1/02*** | (2006.01) |
| ***H04R 9/04*** | (2006.01) |
| ***H04R 7/16*** | (2006.01) |

(52) U.S. Cl.

CPC ..... *H04R 1/028* (2013.01); *H04R 1/025* (2013.01); *H04R 7/16* (2013.01); *H04R 9/046* (2013.01)

(58) Field of Classification Search

None

See application file for complete search history.

(56) References Cited

U.S. PATENT DOCUMENTS

| | | | | |
|---|---|---|---|---|
| 4,811,313 | A * | 3/1989 | Tse | A63J 17/00 369/6 |
| 6,118,884 | A * | 9/2000 | Proni | H04R 9/02 381/400 |
| 2003/0031330 | A1* | 2/2003 | Kim | H04R 1/028 381/111 |
| 2004/0175014 | A1* | 9/2004 | Liu | F21V 33/0056 381/386 |
| 2005/0271232 | A1* | 12/2005 | Sumiyama | H04R 1/025 381/350 |
| 2006/0133637 | A1* | 6/2006 | Proni | H04R 9/06 381/398 |
| 2006/0171107 | A1* | 8/2006 | Yamamoto | G02F 1/133308 361/679.21 |
| 2007/0003100 | A1* | 1/2007 | Liu | H04R 1/028 381/412 |
| 2010/0316247 | A1* | 12/2010 | Ding | G08B 7/066 381/397 |
| 2014/0049939 | A1* | 2/2014 | Kuenzler | F21V 29/63 362/84 |
| 2018/0227654 | A1* | 8/2018 | Majkowski | F21V 3/061 |

* cited by examiner

*Primary Examiner* — Qin Zhu

(74) *Attorney, Agent, or Firm* — Gray Robinson, P.A.; Donald S. Showalter

(57) ABSTRACT

A loudspeaker comprises a circuit board which mounts a number of light units each including multiple LEDs in a position so that when illuminated they are visible though a transparent or translucent diaphragm and protected from exposure to the environment external to the loudspeaker.

10 Claims, 10 Drawing Sheets

ILLUMINATED SPEAKER

FIELD OF THE INVENTION

This invention relates to loudspeakers, and, more particularly, to a loudspeaker having a number of light units each containing at least one source of light such as light-emitting diodes (LEDs) which are protected from the environment external to the loudspeaker.

BACKGROUND OF THE INVENTION

Loudspeakers generally comprise a frame, a motor structure, a diaphragm, a lower suspension or spider and a surround or upper suspension. In one type of speaker, the motor structure includes a permanent magnet sandwiched between a top plate and a back plate, with a pole piece having a through bore centrally mounted on the back plate so that both the top plate and magnet are concentrically disposed about the pole piece. A magnetic gap is formed between the pole piece and top plate within which a voice coil is axially movable. Preferably, the voice coil consists of a hollow, cylindrical-shaped former having an inner surface and an outer surface which mounts a winding of wire.

The voice coil in speakers of the type described above is mounted within the magnetic gap by the upper and lower suspensions and the diaphragm. One end of the diaphragm is connected to the upper suspension, which, in turn, is mounted to the upper end of the frame. The lower suspension is connected at one end to the frame at a point between its upper and lower ends. The free ends of the diaphragm and lower suspension are mounted to the outer surface of the former of the voice coil and support it for axial movement within the magnetic gap. In the course of operation of such speakers, electrical energy is supplied to the voice coil causing it to axially move within the magnetic gap. The voice coil, diaphragm, upper suspension, lower suspension, and dust cap, if present, collectively form an assembly which reciprocates as a unit with the excursion of the voice coil.

Speakers may be mounted within the interior of an enclosure having a front panel formed with an opening such that a forward-facing surface of the diaphragm aligns with the opening. Speaker enclosures may help prevent sound waves produced by the rearward-facing surface of the diaphragm from interacting with those emanating from its forward-facing surface, and help ensure that such sound waves arrive at a listener's ear at substantially the same time.

Speaker systems comprising a loudspeaker and an enclosure may be equipped with light sources such as LEDs. Typically, the LEDs are located in the area of the opening in the front panel of the enclosure, such as in or on a grill placed over such opening, or along a portion of the front panel of the enclosure. This construction may be suitable for indoor use. However, in harsher environments such as outdoor and marine applications where exposure to water, moisture, dirt and other potentially harmful elements is common, mounting LEDs as noted above can damage or render them inoperative.

SUMMARY OF THE INVENTION

This invention is directed to a loudspeaker system which is illuminated by LEDs that are protected from exposure to harmful conditions in the environment external to the loudspeaker.

The loudspeaker of this invention comprises a frame, a motor structure, a diaphragm, a lower suspension or spider and a surround or upper suspension. In the presently preferred embodiment, a spider stand-off ring is connected between the frame and motor structure. Such ring supports a circuit board upon which a number of light units are mounted and connected to a source of power. Each light unit may include a number of LEDs, such as red, green and blue, which are operative to illuminate individually or in combination to produce light of different color(s). A controller may be coupled to the circuit board and the light units causing them to illuminate in a particular flashing pattern or sequence, which may or may not correspond to the audio output of the loudspeaker.

The spider stand-off ring and circuit board it supports are located between the motor structure and diaphragm in position for the LEDs to direct their light output toward the diaphragm. Preferably, the diaphragm is formed of a transparent or translucent, substantially weather-proof material so that the LEDs may be viewed from outside of the loudspeaker. The diaphragm is connected at one end to the surround mounted to the frame, and at its opposite end to the voice coil of the motor structure. A dust cap is preferably fixed to the diaphragm in position overlying the voice coil.

In the presently preferred embodiment, the loudspeaker may be mounted within an enclosure or to a baffle that forms part of an enclosed space for the loudspeaker. In either case, the upper end of the frame is mounted to the enclosure or baffle with a gasket or other sealing member located between them. Accordingly, the upper end of the frame, the upper suspension, the diaphragm and the dust cap collectively form a substantially weather-proof barrier overlying the circuit board and light units which substantially isolates them from the environment external to the speaker. This protects the LEDs and associated circuitry from damage, especially in harsh conditions that may be experienced in marine and other outdoor applications.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
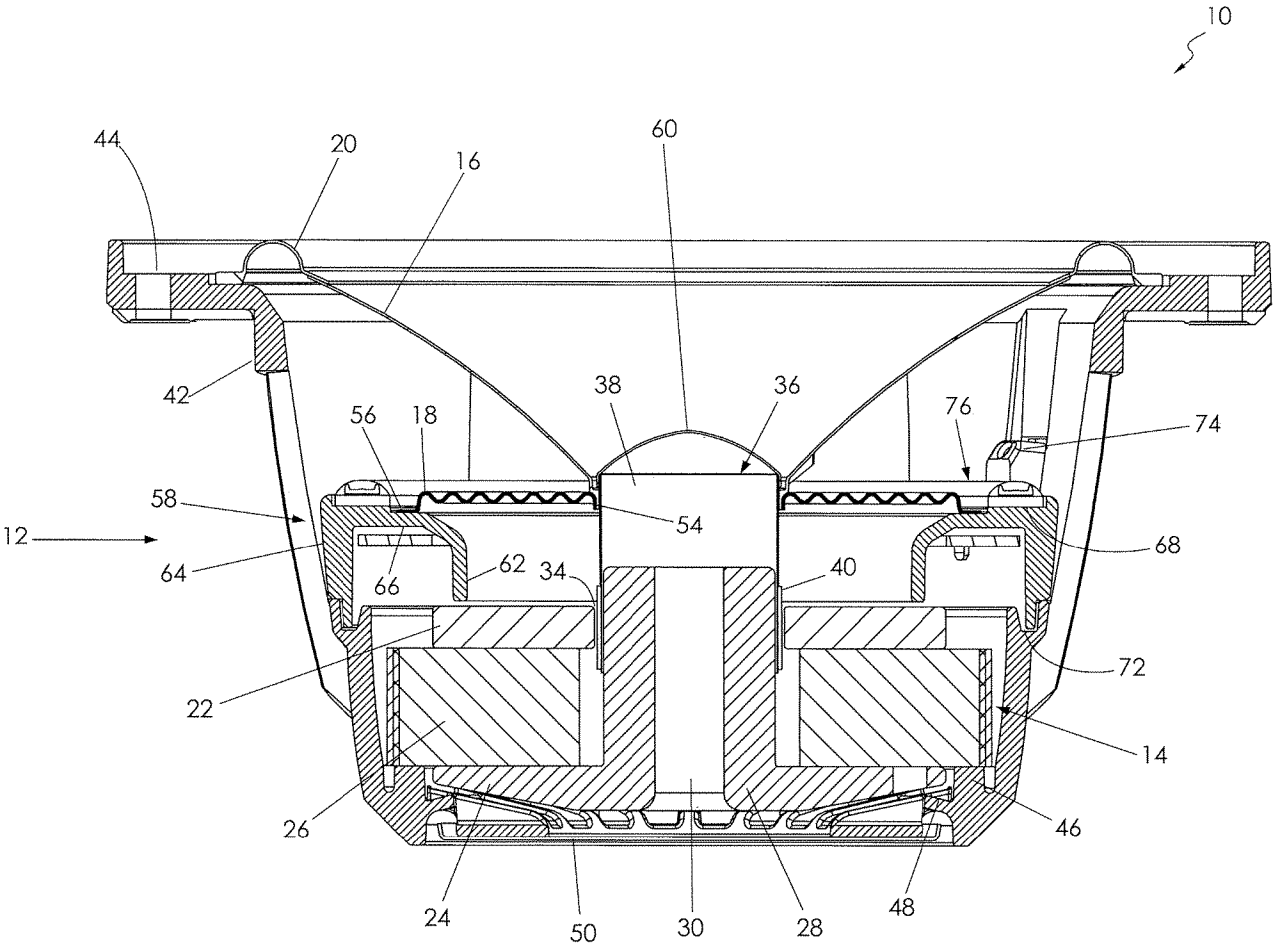
FIG. 1 is an elevational view, in partial cross section, of the loudspeaker
Figure 2:
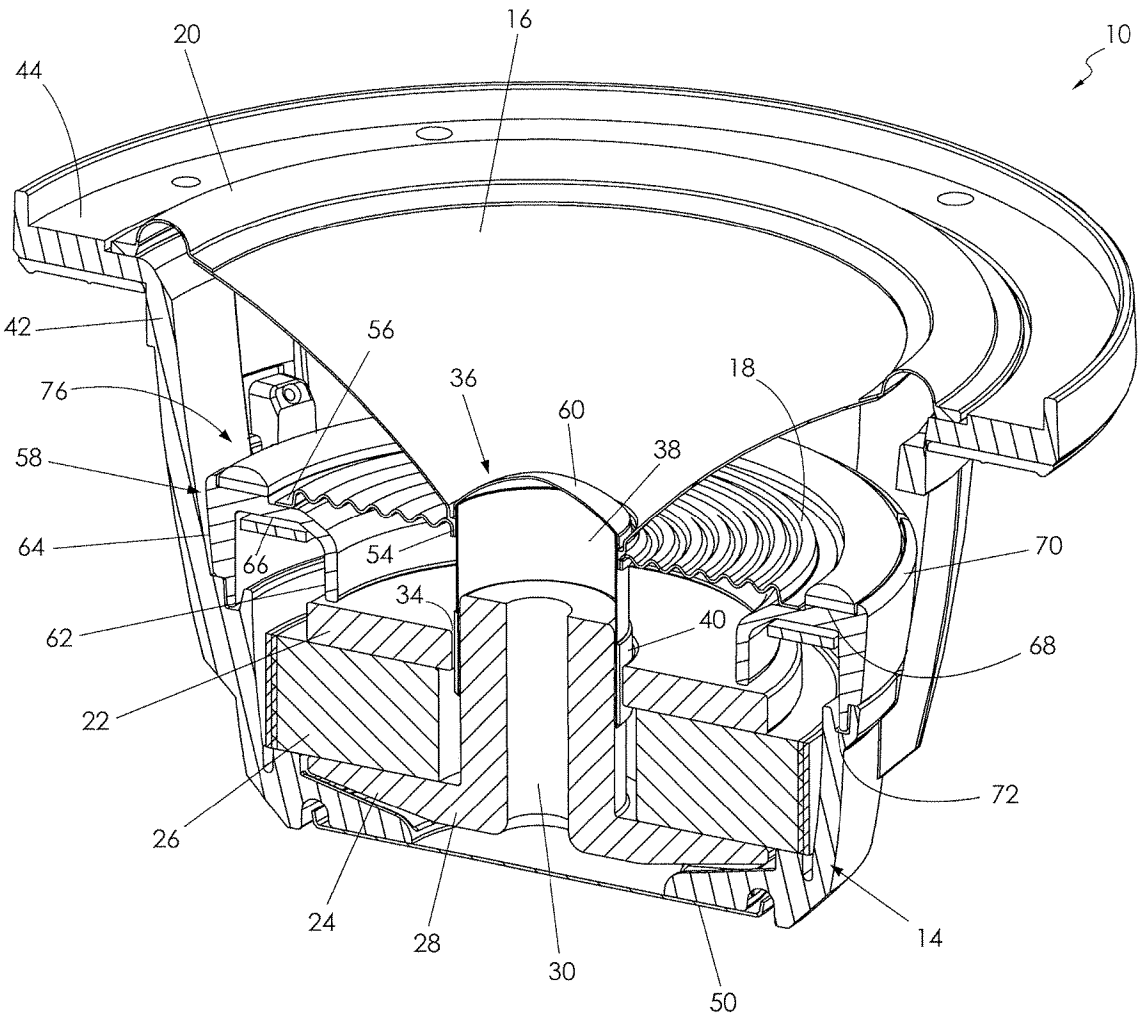
FIG. 2 is a cross sectional perspective view of the loudspeaker shown in FIG. 1.
Figure 3:
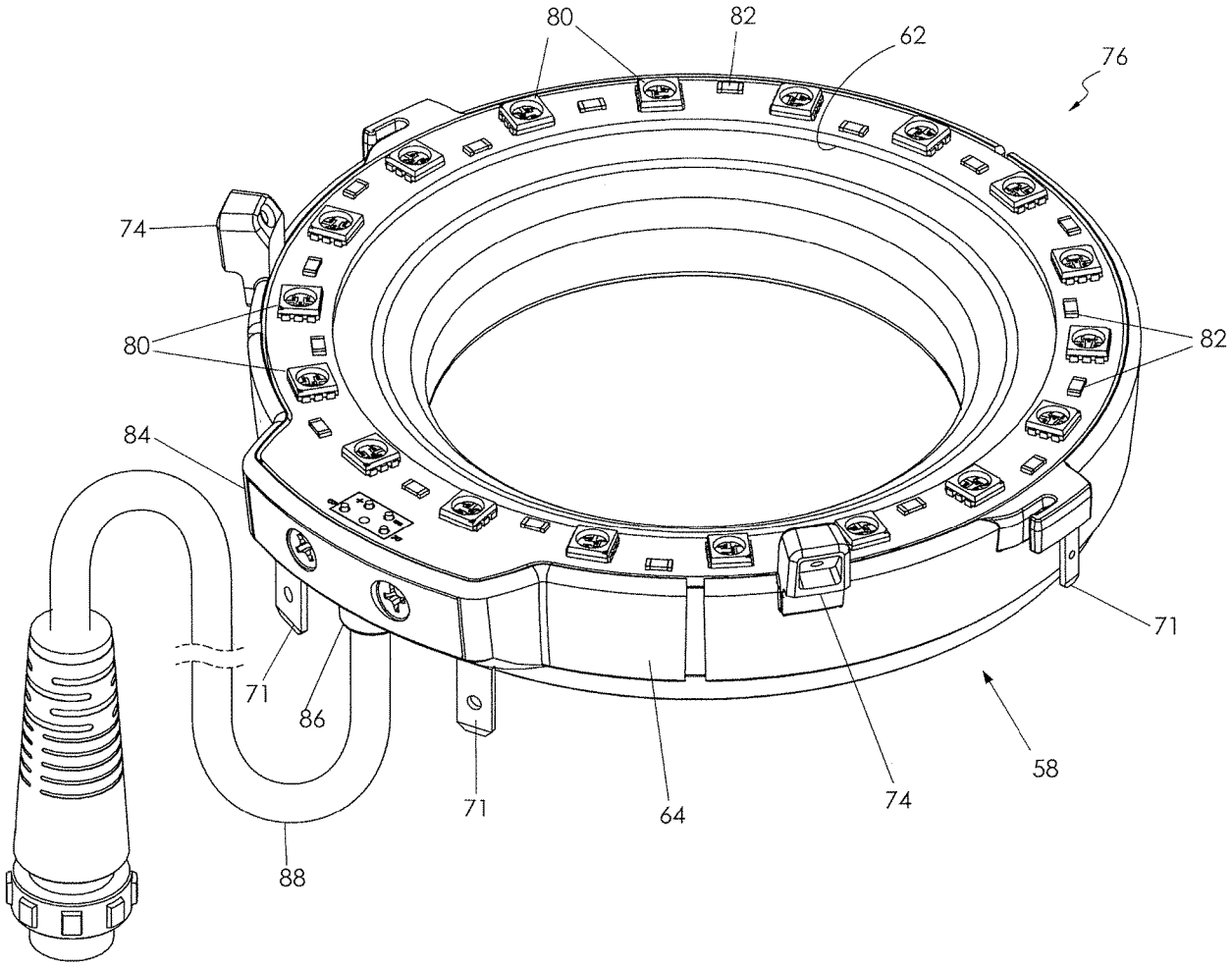
FIG. 3 is a perspective view of a spider stand-off ring and circuit board incorporated in the loudspeaker of FIG. 1.
Figure 4:
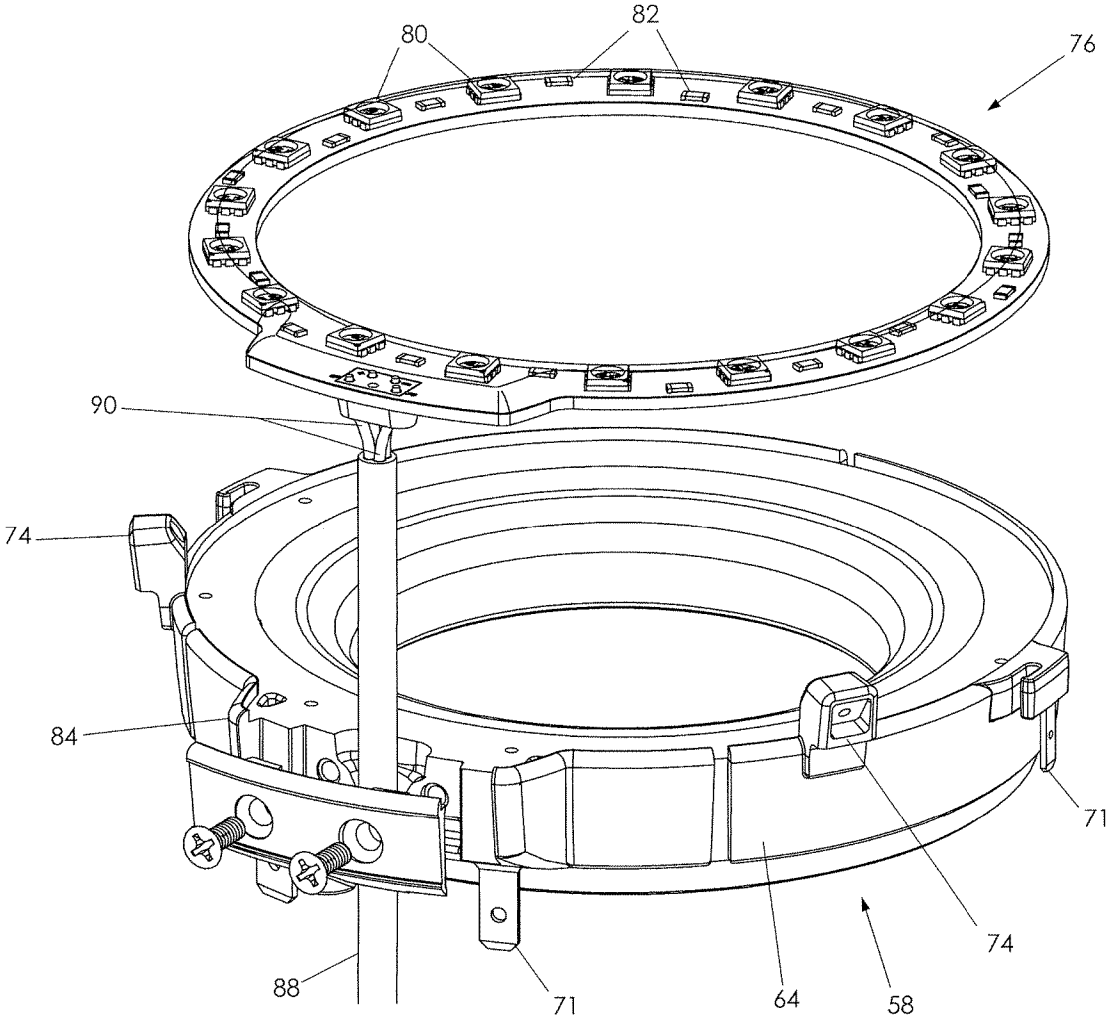
FIG. 4 is a view similar to FIG. 3 except with the circuit board separated from the spider stand-off ring.
Figure 5:
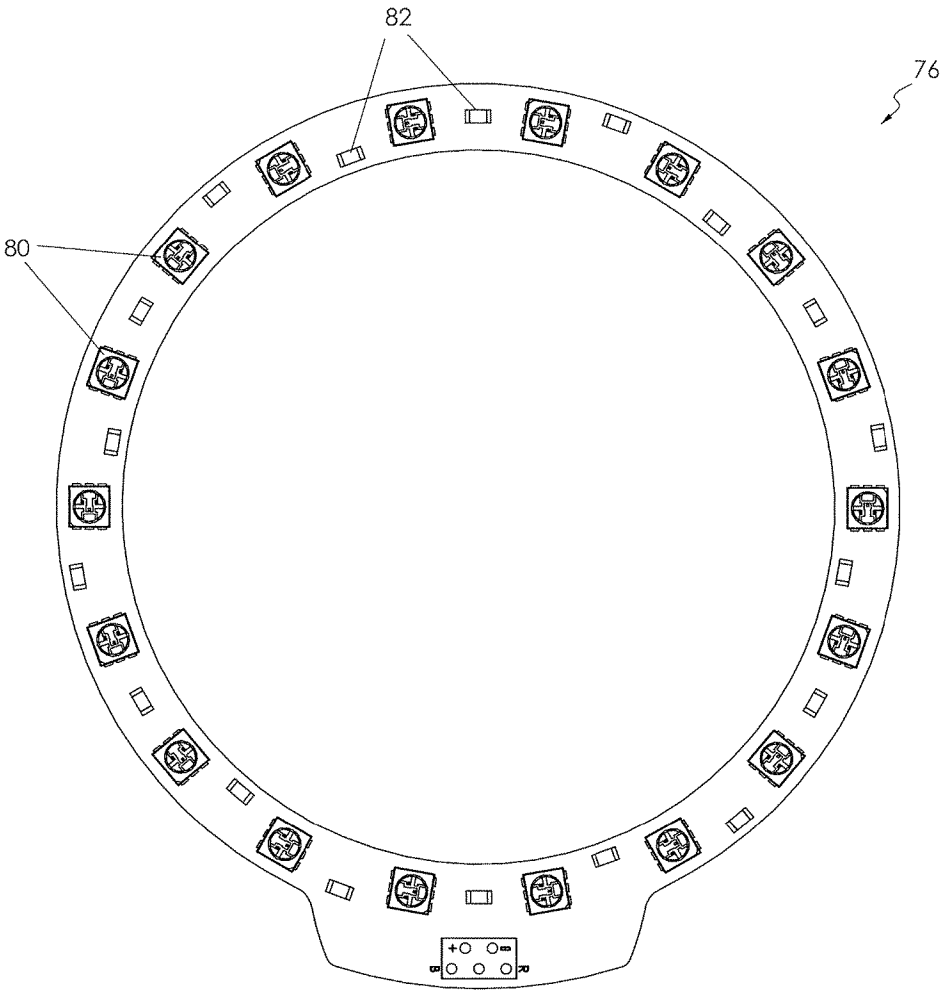
FIG. 5 is a plan view of the circuit board illustrating light units and resistors on its surface.
Figure 6:
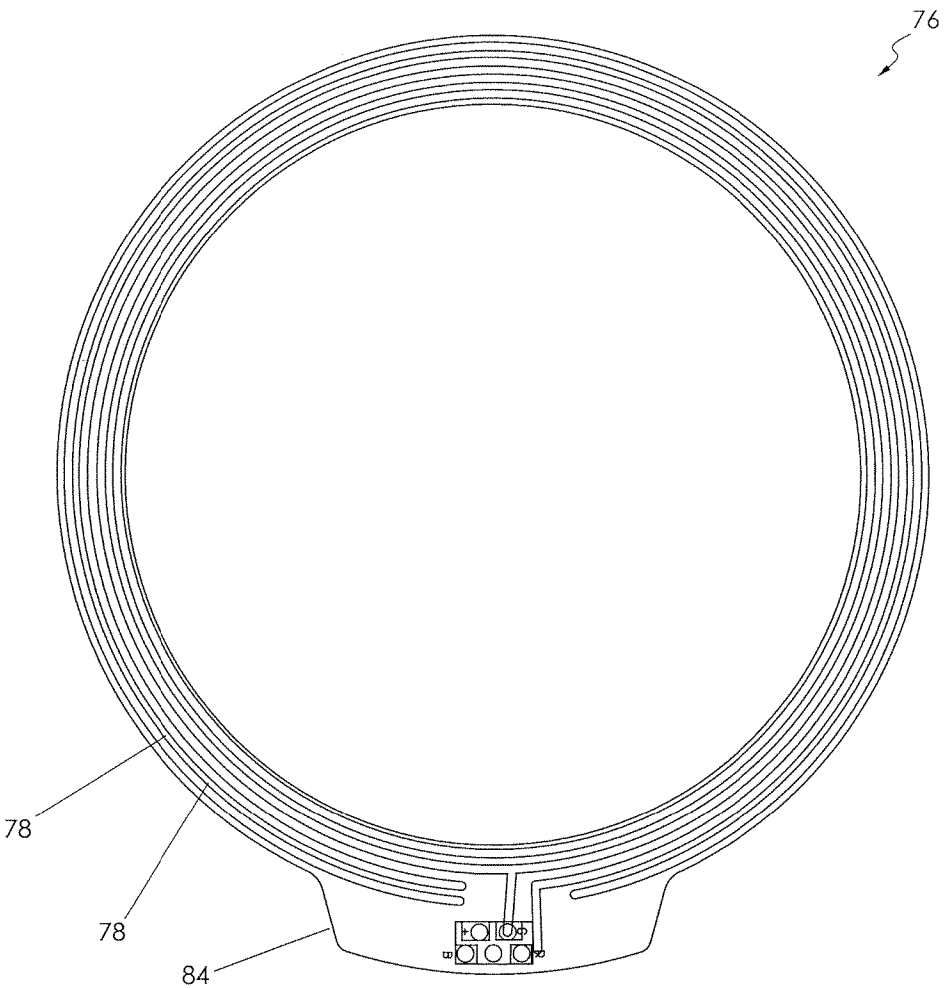
FIG. 6 is a view similar to FIG. 5 except showing traces on the opposite surface of the circuit board.

Referring initially to FIGS. 1 and 2, the speaker 10 of this invention comprises a frame 12, a motor structure 14, a diaphragm 16, a lower suspension or spider 18 and an upper suspension or surround 20. Throughout the following description, the terms "top," "bottom," "upper" and "lower" are meant to refer to directions and/or locations with the speaker 10 in the orientation shown in the Figs. The terms "inner" and "outer" refer to a radial relationship of parts or structure beginning at the longitudinal axis of the speaker 10 which, for purposes of this discussion, is considered to pass through the center of the motor structure 14.

The motor structure 14 comprises a top plate 22 and a back plate 24 which are spaced from one another and mount a permanent magnet 26 between them. A pole piece 28 having a bore 30 is integrally formed with and extends upwardly from the back plate 24 into a central opening formed in both the magnet 26 and top plate 22. A magnetic gap 34 is formed between the top plate 22 and pole piece 28 within which lines of magnetic flux (not shown) are created by the permanent magnet 26. The motor structure 14 further includes a voice coil 36 having a hollow, cylindrical-shaped former 38 whose outer surface mounts a wire winding 40. The former 38 is concentrically disposed about the pole piece 28, and the voice coil 36 is axially movable within the magnetic gap 34 during operation of the speaker 10.

The frame 12 has an upper end, s lower end and a side wall 42 extending between them. The upper end of frame 12 is formed with a flange 44, and its lower end includes an annular boss 46 and an annular shelf 48. As seen in FIG. 1, the magnet 26 of the motor structure 14 rests atop the boss 46 and an outer edge of the back plate 24 is connected to the shelf 48. Preferably, a base plate 50 extends along the lower end of the frame 12 thus enclosing the motor structure 14 within the frame interior 52.

The voice coil 36 is held in place within the magnetic gap 34 by the diaphragm 16, spider 18 and surround 20. A lower end of the diaphragm 26 is affixed to the former 38 of the voice coil 36 by adhesive or the like, and its upper end connects to the surround 20. The surround 20, in turn, is mounted to the flange 44 at the upper end of the frame 12. The spider 18 has an inner edge 54 affixed by adhesive or the like to the former 38 and an outer edge 56 mounted to a spider stand-off ring 58. A dust cap 60 may be mounted to the inner surface of the diaphragm 16, in position above the voice coil 36, as depicted in FIG. 1.

Referring now to FIGS. 1-4, the construction of the spider stand-off ring 58 is shown in detail. In the presently preferred embodiment, the spider stand-off ring 58 includes an inner wall 62 and an outer wall 64 separated by a top wall 66 formed with a seat 68 having an upwardly extending, outer lip 70. Terminals 71 may extend from the outer wall 64. The spider stand-off ring 58 is mounted to the frame 12 by affixing its outer wall 64 within a channel 72 formed in the side wall 42 of the frame 12. In this position, the inner wall 62 of the spider stand-off ring 58 rests on the top plate 22 of the motor structure 14 where it may be secured in place such as by adhesive. Guides 74 may be provided along the outer wall 64 of the spider stand-off ring 58 to receive lead-out wires (not shown).

As best seen in FIGS. 3-6, the seat 68 of the spider stand-off ring 58 mounts a circuit board 76 having traces 78 on its inner or outer surface (FIG. 6) each connected to a number of circumferentially spaced, surface mounted light units 80. Each light unit 80 preferably includes a number of individual LEDs, such as red, green and blue (not shown), which are operative to illuminate individually in those colors or in combinations to produce other colors. Series resistors 82 may be affixed to the circuit board 76 in between light units 80. A protruding section 84 of the outer wall 64 of spider stand-off ring 58 incorporates a sleeve 86 that receives a power cable 88 having multiple wires 90. There may be one wire 90 for each of the individual LEDs, one wire 90 connected to a power source (not shown) and a ground wire.

The circuit board 76 may be connected to a controller (not shown) programmed to illuminate the individual LEDs in light units 80 in essentially any sequence or flashing pattern that may or may not correspond to the audio output of speaker 10. In the presently preferred embodiment, the diaphragm 16 is formed of a transparent or translucent material. As seen in FIG. 1, the circuit board 76 and light units 80 it supports are positioned on the spider stand-off ring 58 so that illumination from the LEDs is readily visible through the diaphragm 16 externally of the speaker 10.

Figure 7:
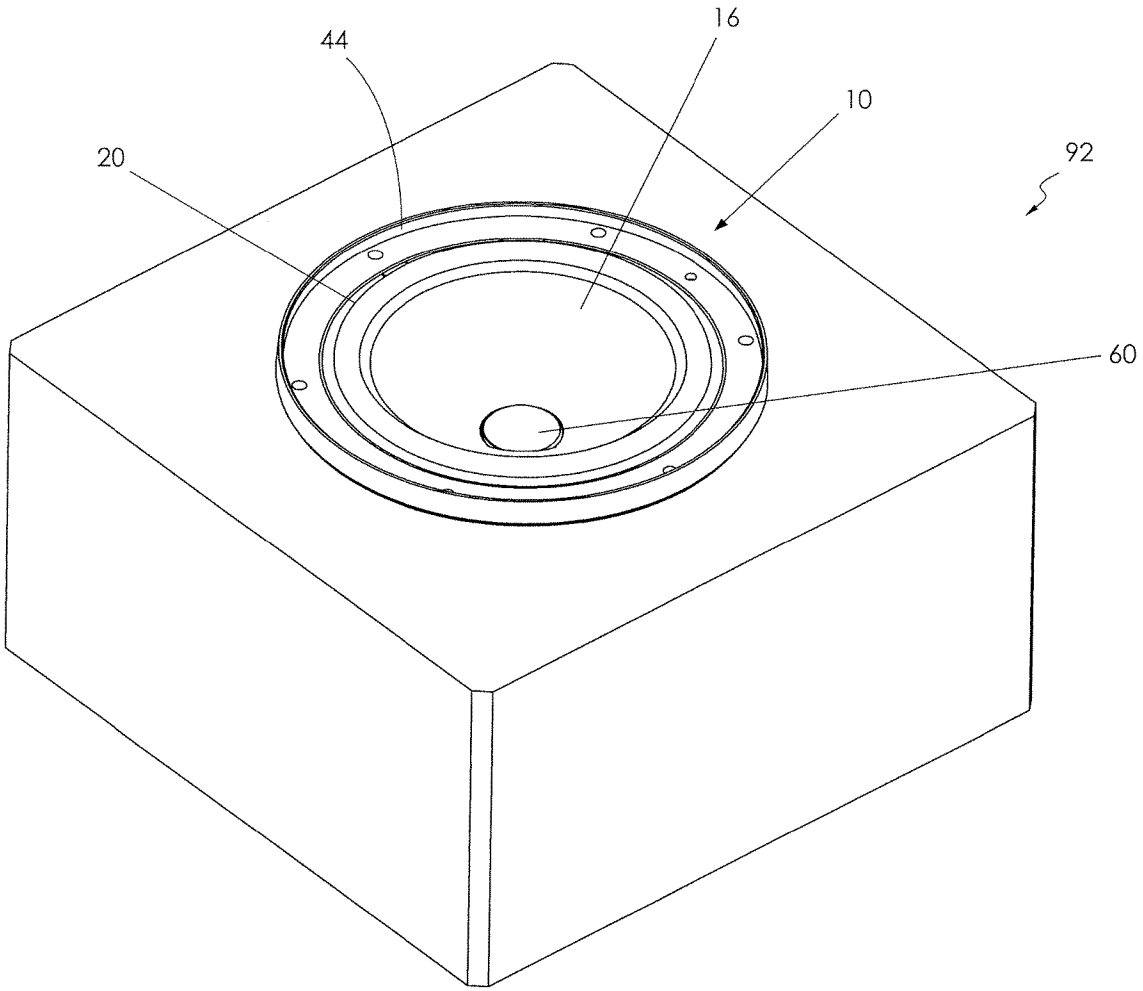
FIG. 7 is a diagrammatic, perspective view of the loudspeaker of this invention mounted within an enclosure.
Figure 8:
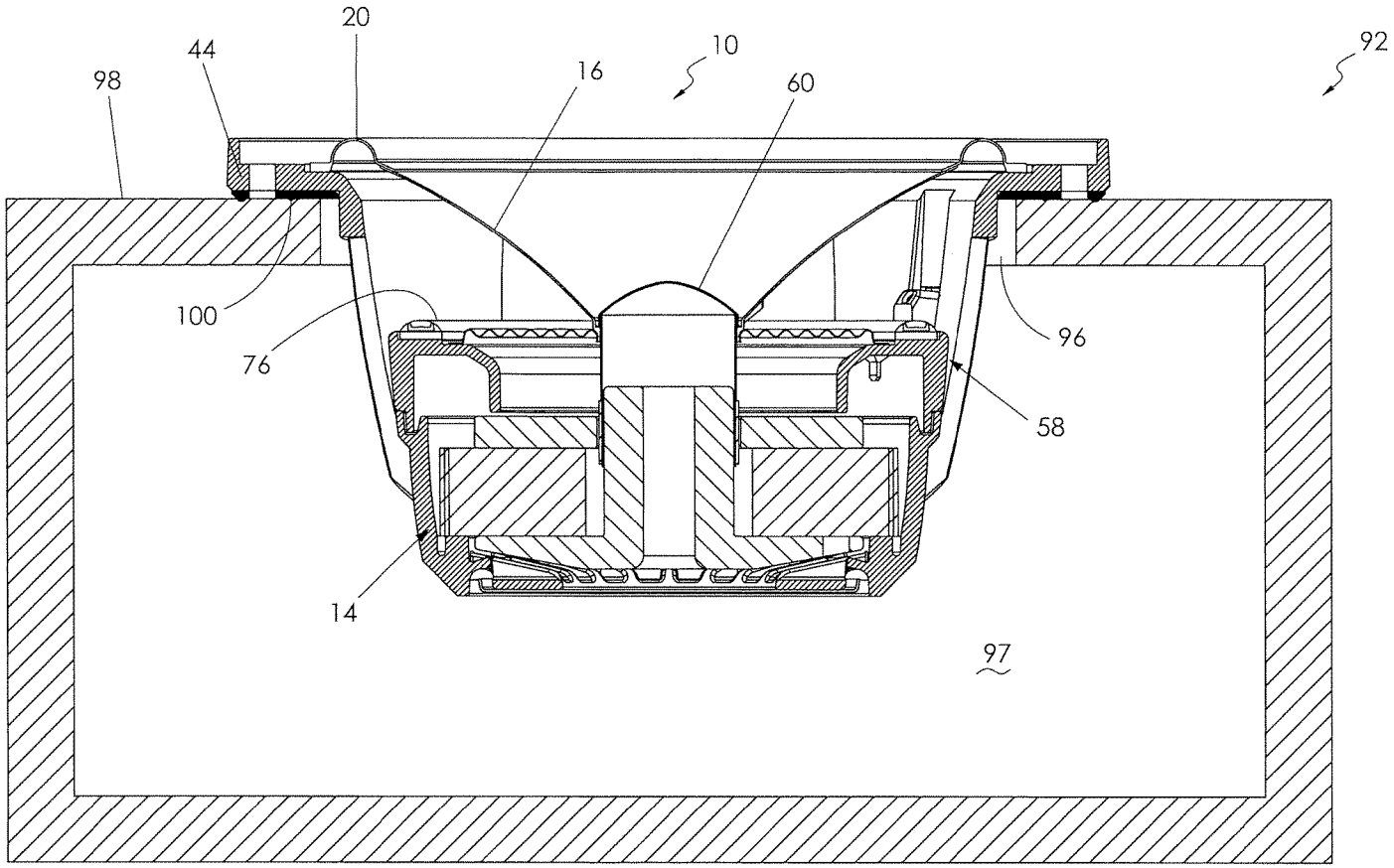
FIG. 8 is a cross section view of the loudspeaker and enclosure depicted in FIG. 7.

An important aspect of this invention is the construction of speaker 10 in such a way as to protect the circuit board 76, and all of the electrical components thereon, from damage or destruction that may arise from exposure to the environment external to the speaker 10. With reference to FIGS. 7-10, the speaker 10 is schematically illustrated as being mounted within an enclosure 92 or to a baffle 94. As seen in FIGS. 7 and 8, an opening 96 is formed in one wall 98 of the enclosure 92 through which the speaker 10 is inserted into the enclosure interior 97 except for the flange 44 on the upper end of frame 12. The flange 44 rests atop the wall 98 and preferably a gasket 100 is located between the flange 44 and wall 98 to create a weather-tight seal. The flange 44 may be connected to the wall 98 by screws (not shown).

Figure 9:
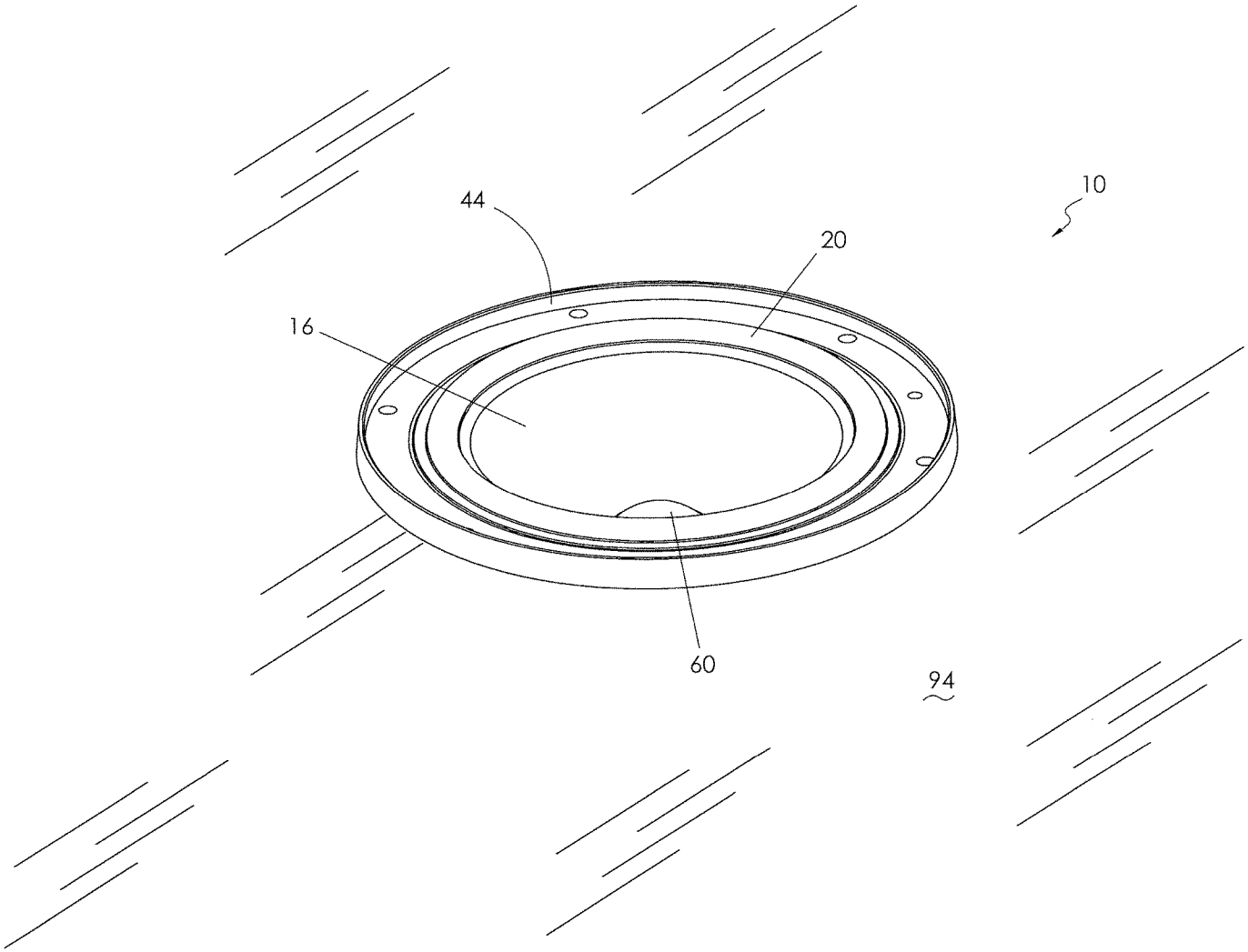
FIG. 9 is a diagrammatic, perspective view of the loudspeaker of this invention mounted to a baffle.
Figure 10:
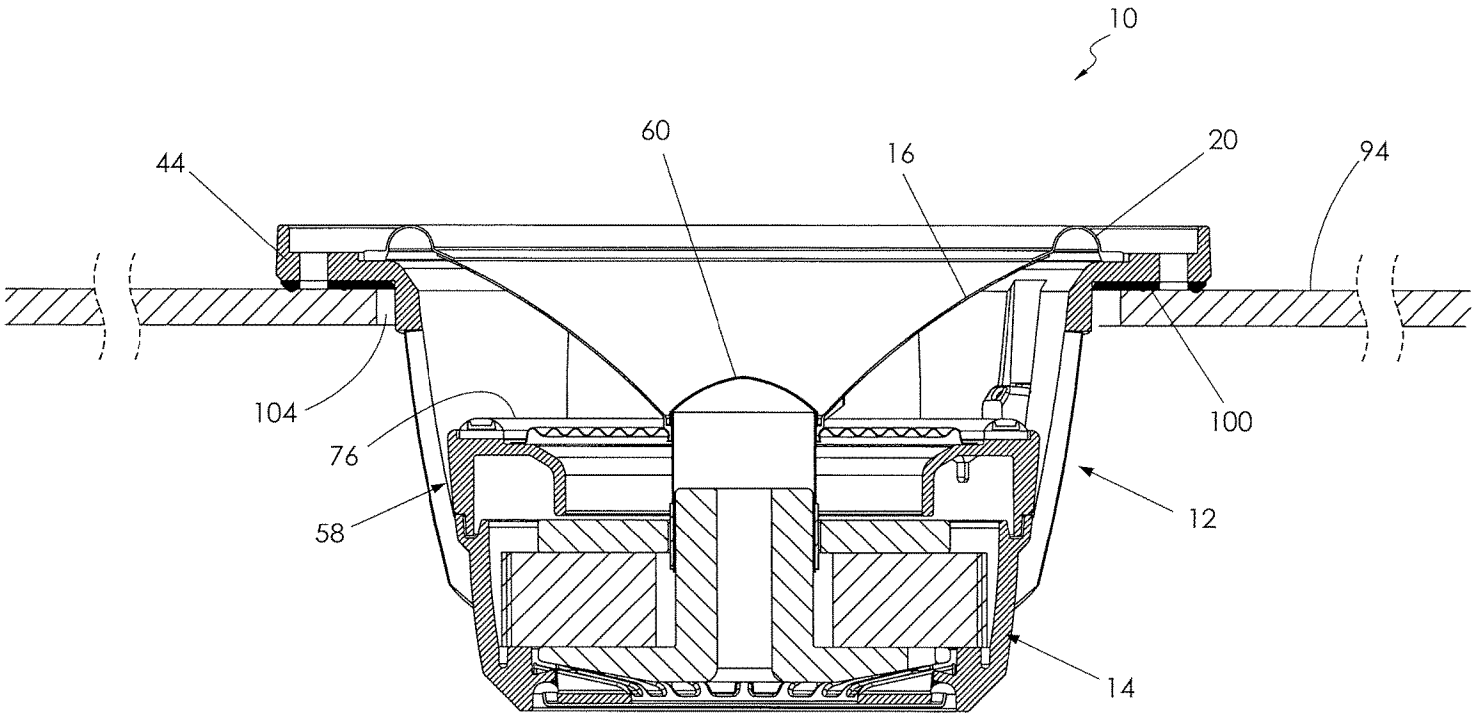
FIG. 10 is a cross section view of the loudspeaker and baffle shown in FIG. 9.

The baffle 94 diagrammatically shown in FIGS. 9 and 10 may be a wall of a structure, such as the side wall, ceiling or other structure of a boat, house etc. wherein a space 102 is provided on the opposite side of such baffle 94 within which the speaker 10 may be located. The baffle 94 is formed with an opening 104 through which the speaker 10 may be inserted such that the flange 44 of the speaker frame 12 contacts the baffle 94 where it may be connected by screws (not shown).

As illustrated in FIGS. 8 and 10, whether the speaker 10 is mounted within an enclosure 92 or inside of a space 102 formed by a baffle 94, the only parts of the speaker 10 exposed to the outside environment are the upper flange 44 of the frame 12, the surround 20, the diaphragm 16 and the dust cap 60. All of these components are made of substantially weather-proof material. As noted above, the circuit board 76 and all of the electrical elements it carries, including the traces 78, LED units 80, resistors 82 and wires 90, are located beneath the surround 20, diaphragm 16, dust cap 60 and the upper flange 44 of the frame 22, in the orientation of the speaker 10 depicted in the Figs. These components of the speaker 10 collectively form a barrier to protect the circuit board 76 and such electrical elements from exposure to the environment outside of the speaker 10, when the speaker 10 is mounted within an enclosure 92 or to a baffle 94, as discussed above. This is a significant improvement over prior illuminated speaker systems in which LEDs and other electrical components are mounted in a position on a speaker enclosure or baffle where they are exposed to the weather.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. For example, FIGS. 1, 2, 8 and 10 depict the loudspeaker 10 as including a dust cap 60. The diaphragm 16 could be modified to attach to the voice coil 36 in such a way as to seal it from the external environment such that a dust cap 60 would not be required.

Therefore, it is intended that the invention not be limited to the particular embodiment disclosed as the best mode contemplated for carrying out this invention, but that the invention will include all embodiments falling within the scope of the appended claims.

What is claimed is:

1. A loudspeaker, comprising:

a motor structure;

a frame connected to said motor structure;

a stand-off ring mounted to said frame, said stand-off ring comprising a first wall, a second wall spaced from said first wall and a third wall extending between said first and second walls;

a lower suspension connected between said motor structure and said third wall of said stand-off ring;

a circuit board connected to said third wall of said stand-off ring, said circuit board mounting at least one light unit operative to produce illumination;

an upper suspension connected to said frame;

a diaphragm connected between said motor structure and said upper suspension, said diaphragm being formed of a transparent or translucent material through which illumination from said at least one light unit may be viewed exteriorly of the loudspeaker;

a dust cap mounted to said diaphragm in position over at least a portion of said motor structure;

said upper suspension, said diaphragm, said dust cap and at least a portion of said frame collectively forming a barrier to protect said circuit board from exposure to elements external to the loudspeaker.

2. The loudspeaker of claim 1 in which said at least one light unit comprises a number of light units each including one or more LEDs.

3. The loudspeaker of claim 2 in which said circuit board is formed with a number of traces each connected to at least one of the LEDs in each of the light units.

4. The loudspeaker of claim 1 in which said frame is formed with a channel, said first wall of said stand-off ring being mounted within said channel.

5. The loudspeaker of claim 1 in which said second wall of said stand-off ring is coupled to said motor structure.

6. The loudspeaker of claim 1 in which said stand-off ring is formed with a sleeve which receives a power cable coupled to said at least one light unit.

7. A loudspeaker system, comprising:

an enclosure having a wall formed with an opening and an interior;

a loudspeaker, comprising:

(i) a motor structure;

(ii) a frame connected to said motor structure;

(iii) a stand-off ring mounted to said frame, said stand-off ring comprising a first wall, a second wall spaced from said first wall and a third wall extending between said first and second walls;

(iv) a lower suspension connected between said motor structure and said third wall of said stand-off ring;

(v) a circuit board connected to said third wall of said stand-off ring, said circuit board mounting at least one light unit operative to produce illumination;

(vi) an upper suspension connected to said frame;

(vii) a diaphragm connected between said motor structure and said upper suspension, said diaphragm being formed of a transparent or translucent material through which illumination from said at least one light unit may be viewed exteriorly of the loudspeaker;

(viii) a dust cap mounted to said diaphragm in position over at least a portion of said motor structure;

said loudspeaker being inserted through said opening in said enclosure such that said circuit board is located within said interior of said enclosure, said frame of said loudspeaker being connected to said wall of said enclosure, said upper suspension, said diaphragm, said dust cap and at least a portion of said frame collectively forming a barrier to protect said circuit board from exposure to the environment external to said loudspeaker and said interior of said enclosure.

8. The loudspeaker of claim 7 in which said frame is formed with a channel, said first wall of said stand-off ring being mounted within said channel.

9. The loudspeaker of claim 7 in which said second wall of said stand-off ring is coupled to said motor structure.

10. The loudspeaker of claim 7 in which said stand-off ring is formed with a sleeve which receives a power cable coupled to said at least one light unit.

* * * * *